US008801465B2

(12) United States Patent
Yeh et al.

(10) Patent No.: US 8,801,465 B2
(45) Date of Patent: Aug. 12, 2014

(54) USB DEVICE WITH STRENGTHENED HOUSING

(71) Applicants: Ambit Microsystems Ltd., Shanghai (CN); Hon Hai Precision Industry Co., Ltd., New Taipei (TW)

(72) Inventors: Chih-Yu Yeh, New Taipei (TW); Dong Qin, Shanghai (CN)

(73) Assignees: Ambit Microsystems (Shanghai) Ltd., Shanghai (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/734,938

(22) Filed: Jan. 5, 2013

(65) Prior Publication Data

US 2013/0183860 A1 Jul. 18, 2013

(30) Foreign Application Priority Data

Jan. 13, 2012 (CN) ..... 2012 1 0009711

(51) Int. Cl.
*H01R 24/66* (2011.01)

(52) U.S. Cl.
USPC ..... 439/607.13; 439/76.1

(58) Field of Classification Search
USPC ..... 439/6–13, 76.1, 677, 607.01, 607.13, 439/607.3, 701
See application file for complete search history.

(56) References Cited

U.S. PATENT DOCUMENTS

| | | | | |
|---|---|---|---|---|
| 6,695,620 | B1 * | 2/2004 | Huang | 439/11 |
| 6,733,329 | B2 * | 5/2004 | Yang | 439/638 |
| 6,991,467 | B1 * | 1/2006 | Cheng et al. | 439/10 |
| 7,066,753 | B1 * | 6/2006 | Tseng | 439/259 |
| 7,128,615 | B1 * | 10/2006 | Liao | 439/640 |
| 7,479,041 | B1 * | 1/2009 | Chen | 439/630 |
| 7,507,119 | B2 * | 3/2009 | Ni et al. | 439/607.31 |
| 7,641,501 | B2 * | 1/2010 | Uchikawa et al. | 439/362 |
| 7,670,190 | B2 * | 3/2010 | Shi et al. | 439/640 |
| 7,766,660 | B1 * | 8/2010 | Chang | 439/11 |
| 7,789,711 | B2 * | 9/2010 | Wu | 439/640 |
| 7,815,471 | B2 * | 10/2010 | Wu | 439/640 |
| 7,824,227 | B1 * | 11/2010 | Lee et al. | 439/660 |
| 7,955,124 | B2 * | 6/2011 | Su et al. | 439/76.1 |
| 8,157,569 | B1 * | 4/2012 | Liu | 439/11 |
| 2009/0197474 | A1 * | 8/2009 | Wei et al. | 439/669 |
| 2010/0091469 | A1 * | 4/2010 | Lin | 361/752 |
| 2010/0123006 | A1 * | 5/2010 | Chen | 439/607.01 |
| 2010/0151718 | A1 * | 6/2010 | Li | 439/354 |
| 2010/0221936 | A1 * | 9/2010 | Zhao et al. | 439/135 |
| 2012/0008268 | A1 * | 1/2012 | Jiang et al. | 439/528 |
| 2012/0100746 | A1 * | 4/2012 | Wu | 439/607.01 |

FOREIGN PATENT DOCUMENTS

CN 201010257477.X 10/2011

* cited by examiner

*Primary Examiner* — Briggitte R Hammond
(74) *Attorney, Agent, or Firm* — Novak Druce Connolly Bove + Quigg LLP

(57) ABSTRACT

A USB device includes a main body, a PCB fixed in the main body and a USB connector connected to the main body. The USB connector includes a shell, a USB plug and a cover. The shell defines a receiving room, a first opening and a second opening and includes an integrally formed enclosure enclosing the receiving room and a first flange outwardly protruding from the enclosure. The USB plug electrically connects to a wire group and is inserted into the shell from the first opening. The cover shields the second opening and is fixed to the shell. The cover includes a second flange engaging with the first flange to cooperatively receive the wire group and connect to the main body.

20 Claims, 9 Drawing Sheets

USB DEVICE WITH STRENGTHENED HOUSING

BACKGROUND

1. Technical Field

The present disclosure relates to a portable electronic device, and more particularly to a Universal Serial Bus (USB) device.

2. Description of Related Art

A USB device, for example, a wireless network card, a USB flash disk, connects with an electronic product (such as a personal computer) to transmit data and signals by a USB plug of the USB device. Generally, the USB plug is secured by a housing connected to a main body of the USB device. The housing includes a top cover and a bottom cover. The USB plug is fixed between the top cover and the bottom cover. However, during inserting or removing the USB plug into or from the electronic product, a junction between the top cover and the bottom cover tends to be damaged easily due to excessive load. How to design the USB device having a strengthened housing to secure the USB plug is a question for discussion.

Therefore, a need exists in the industry to overcome the described limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
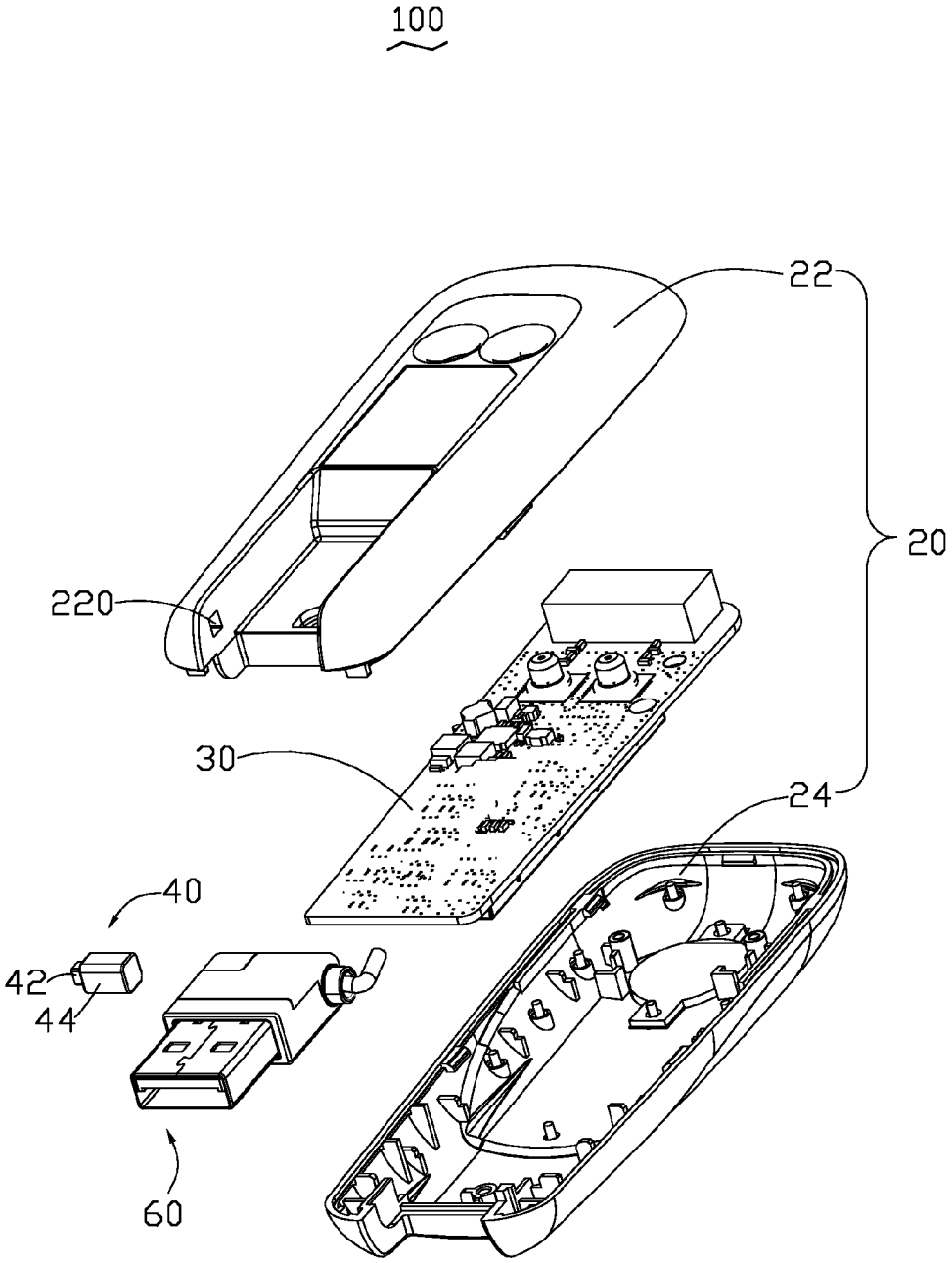
FIG. 1 is a disassembled perspective view of a USB device in accordance with an exemplary embodiment of the disclosure.

In FIG. 1, a USB device 100 comprises a main body 20, a printed circuit board (PCB) 30 in the main body 20, a hinge assembly 40 and a USB connector 60 pivotably connected to the main body 20 via the hinge assembly 40 and used to electrically connect the USB device 100 to a peripheral equipment (not shown). In the illustrated embodiment, the USB device 100 may be a wireless network card or a USB flash disk for example. The peripheral equipment maybe a notebook personal computer or a tablet personal computer for example.

The main body 20 comprises a first cover 22 and a second cover 24 cooperatively defining a cavity for receiving the PCB 30. The first cover 22 defines a fixing hole 220 for securing the hinge assembly 40. The hinge assembly 40 comprises a hinge portion 42 and a sleeve portion 44 rotatably engaging with each other. The hinge portion 42 is fixed in the fixing hole 220. The sleeve portion 44 is fixed in the USB connector 60. Therefore, the USB connector 60 is capable of rotating relative to the main body 20

Figure 2:
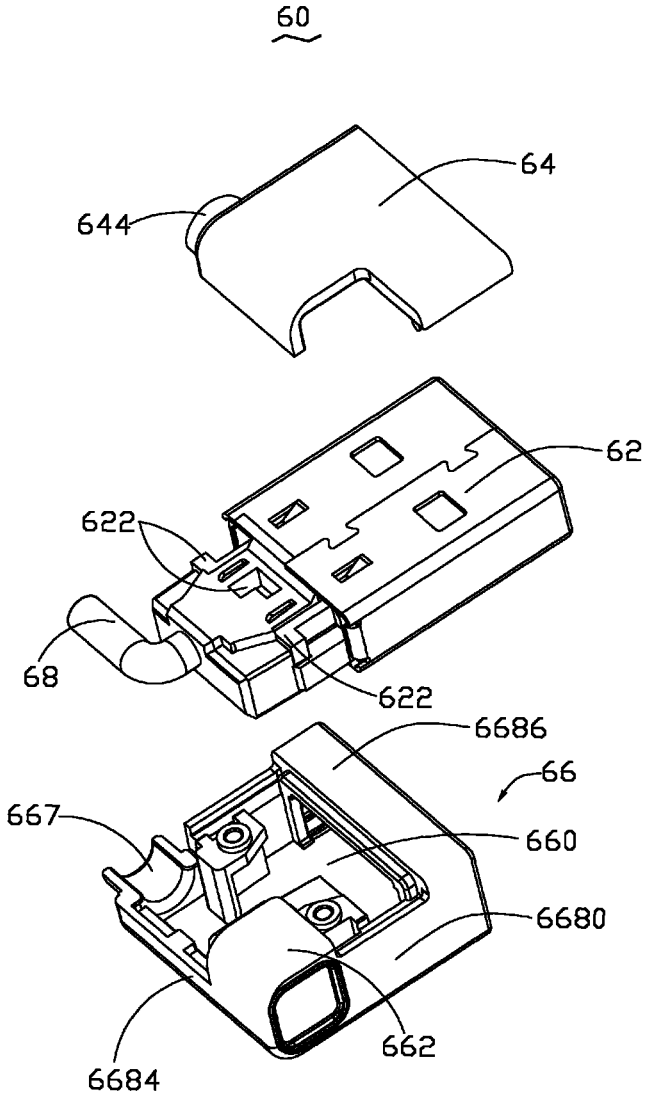
FIG. 2 is a disassembled perspective view of the USB device in accordance with a first exemplary embodiment of the disclosure.
Figure 3:
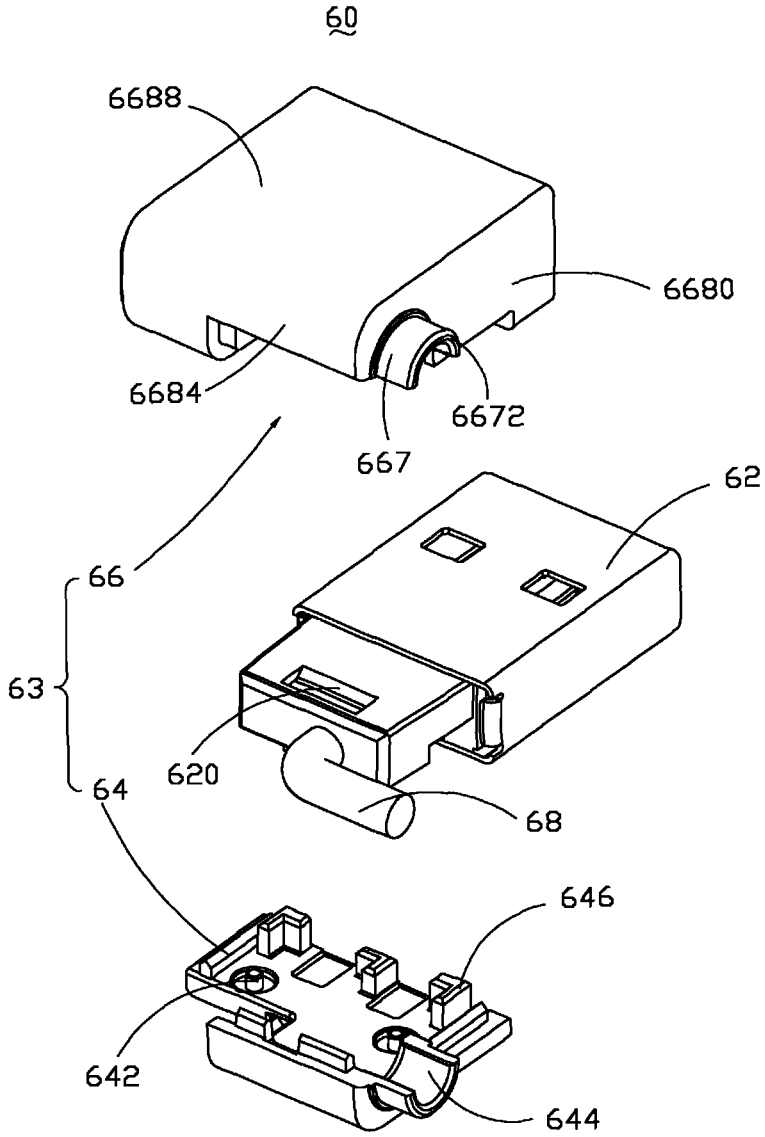
FIG. 3 is similar to FIG. 2, but shown in another direction.

In FIG. 2 and FIG. 3, the USB connector 60 of the USB device 100 in accordance with a first exemplary embodiment of the disclosure is shown. The USB connector 60 comprises a USB plug 62, a housing 63 comprising a cover 64 and a shell 66 used to secure the USB plug 62 and rotatably connected to the main body 20 via the hinge assembly 40 and a wire group 68 electrically connected between the USB plug 62 and the PCB 30. Junction between the wire group 68 and the USB plug 62 is packed by plastic material, providing protection function for the wire group 68, which is not easily damaged during rotation of the USB connector 60 relative to the main body 20.

Figure 4:
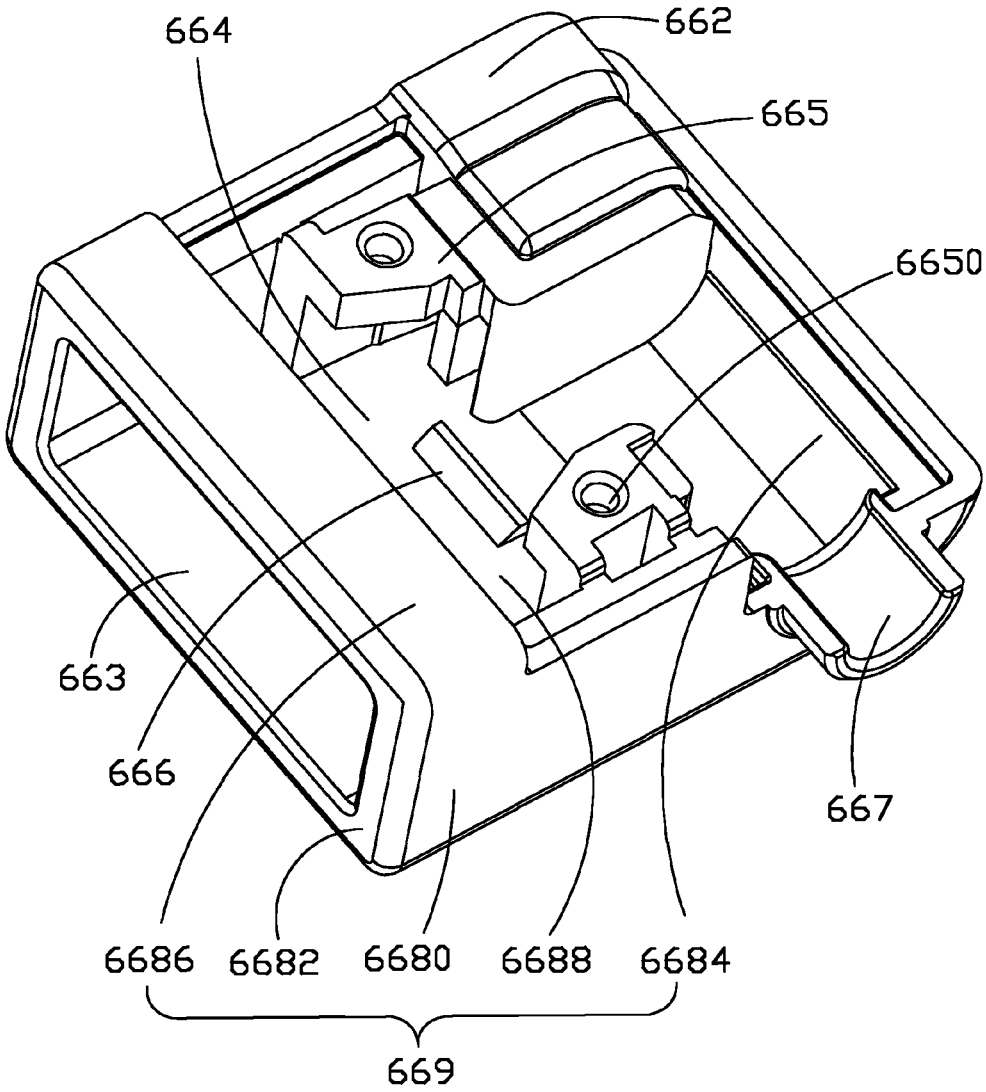
FIG. 4 is a perspective view of a shell of a USB connector of the USB device in accordance with the first exemplary embodiment of the disclosure.

In FIG. 4, the shell 66 is integrally formed by plastic material and comprises a pair of side walls 6680, a front wall 6682, a back wall 6684, a top wall 6686 and a bottom wall 6688 cooperatively defining a receiving room 660. The shell 66 defines a first opening 663 and a second opening 664 respectively communicating the receiving room 660 with exterior of the shell 66. The first opening 663 is formed in the front wall 6682 and substantially rectangular in shape. The second opening 664 is formed among the top wall 6686, the pair of side walls 6680 and the back wall 6684 and opposite to the bottom wall 6688. The top wall 6686, the pair of side walls 6680, the bottom wall 6688 and the front wall 6682 are integrally formed with each other and cooperatively define the first opening 663 for providing an entrance of the USB plug 62 being partially inserted into the receiving room 660.

The pair of side walls 6680, the front wall 6682, the back wall 6684, the top wall 6686 and the bottom wall 6688 cooperatively form an integrally formed enclosure 669 enclosing the receiving room 660 and having the first opening 663 formed at front of the enclosure 669 and the second opening 664 formed at top of the enclosure 669.

The shell 66 further comprises a containing portion 662, a pair of positioning portions 665, a latching block 666 and a first flange 667. The containing portion 662 is configured at a corner of the shell 66 and close to the back wall 6684. In assembly, the sleeve portion 44 of the hinge assembly 40 is fixed in the containing portion 662. The pair of positioning portions 665 are close to the second opening 664 and respectively inwardly protrude from the pair of side walls 6680 toward the receiving room 660. One of the pair of positioning portions 665 is connected between one of the side walls 6680 and the containing portion 662. Each of the positioning portions 665 defines a positioning hole 6650. In this embodiment, the pair of positioning portions 665 are parallel with the bottom wall 6688. The latching block 666 inwardly protrudes from the bottom wall 6688. The first flange 667 outwardly protrudes from one of the pair of side walls 6680 and is opposite to the containing portion 662 and close to the back wall 6684. An end surface 6672 of the first flange 667 is half-annular shaped.

The cover 64 comprises a pair of positioning posts 642 respectively opposite to the pair of positioning holes 6650. In assembly, the cover 64 shields the second opening 664 of the shell 66. The cover 64 is positioned to the shell 66 by engagements between the pair of positioning posts 642 and the pair of positioning holes 6650. The cover 64 further comprises one or more first positioning blocks 646 and a second flange 644. The first positioning blocks 646 are close to one edge of the cover 64 and arranged on a same row. The second flange 644 has a same structure with the first flange 667 of the shell 66 and is used to engage with the first flange 667 to cooperatively form an export for the wire group 68. That is, the first flange 667 and the second flange 644 cooperatively receive a middle section of the wire group 68. In assembly, the first flange 667 and the second flange 644 are connected to the main body 20 to communicate the receiving room 660 to inner of the main body 20, therefore, the wire group 68 can be inserted into the main body 20 to be connected to the PCB 30.

The USB plug 62 defines a latching groove 620 and comprises one or more second positioning blocks 622. The latching groove 620 and the second positioning blocks 622 are respectively located two opposite surfaces of the USB plug 62.

Figure 5:
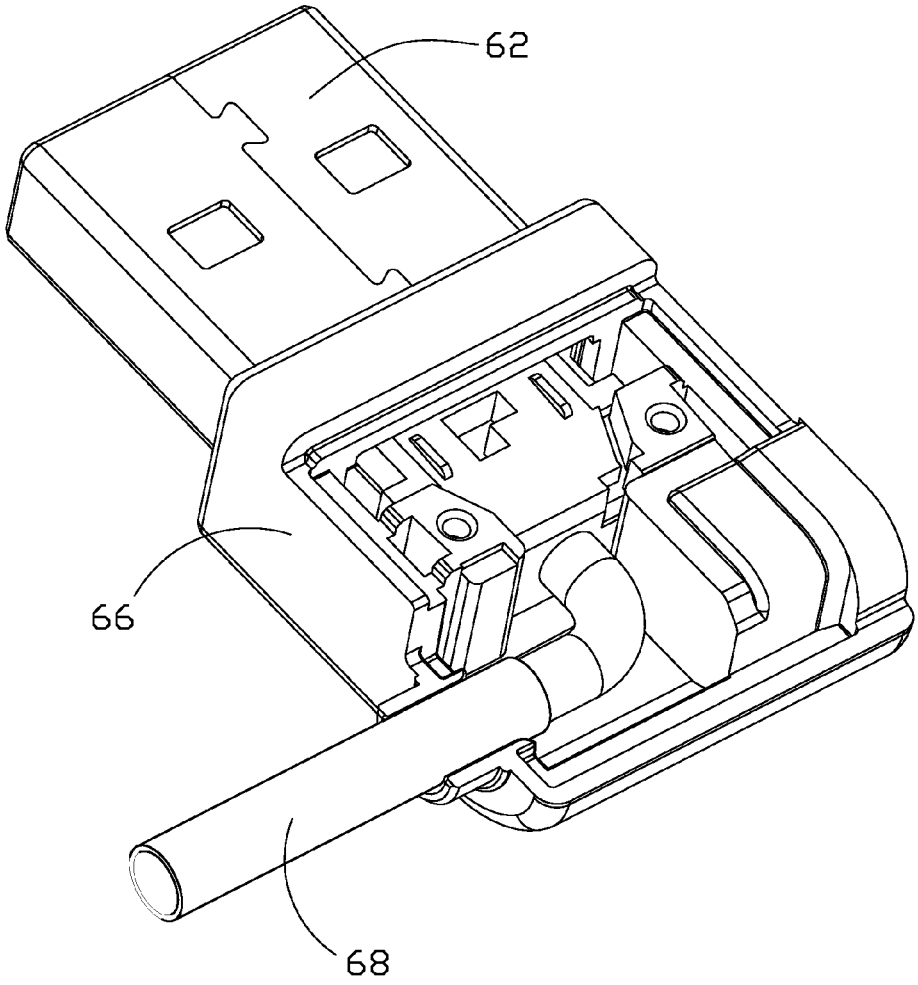
FIG. 5 is a perspective view of the USB connector of the USB device with a cover removed.
Figure 6:
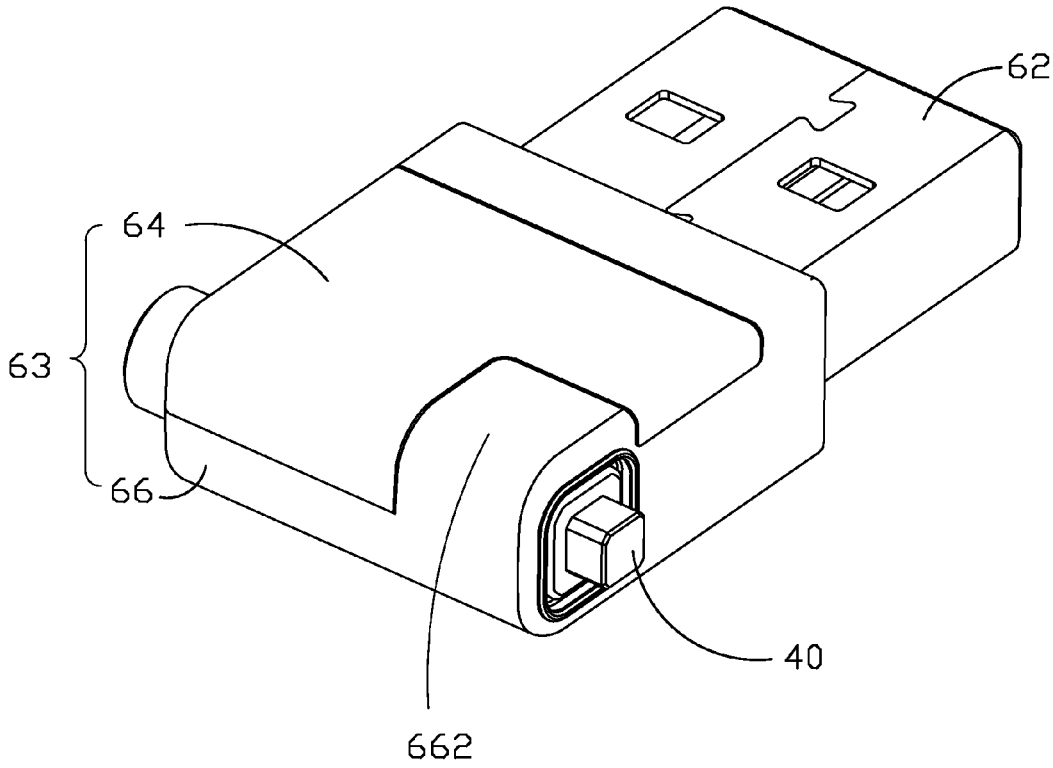
FIG. 6 is a perspective view of the USB connector of the USB device with a hinge assembly installed in the USB connector.

In FIG. 5 and FIG. 6, in assembly, the USB plug 62 is installed into the shell 66 with one end of the USB plug 62 connected to the wire group 68 passing through the first opening 663 and inserted into the receiving room 660. The latching block 666 of the shell 66 engages with the latching groove 620 of the USB plug 62 to position the USB plug 62 to the shell 66. Part of the USB plug 62 is received between the positioning portions 664 and the bottom wall 6688 of the shell 66. The wire group 68 passes through a passage between the first flange 667 and the second flange 644 to be inserted into the main body 20. The cover 64 is installed to the shell 66 and shields the second opening 664. The pair of positioning posts 642 are respectively inserted into the pair of positioning holes 6650. The first positioning blocks 646 respectively engage with the second positioning blocks 622. Thus, the cover 64 and the USB plug 62 are installed to the shell 66, and part of the USB plug 62 exposed outside of the shell 66 is used to engage with a socked of the peripheral equipment.

The sleeve portion 44 is fixed into the containing portion 662, and the hinge portion 42 is fixed in the fixing hole 220 of the main body 20, to rotatably install the USB connector 60 to the main body 20. The wire group 68 is inserted into the main body 20 to be connected to the PCB 30.

The USB connector 60 has a strengthened structure at the first opening 662 of the shell 66, due to the top wall 6686, the pair of side walls 6680, the bottom wall 6688 and the front wall 6682 being integrally formed with each other and cooperatively defining the first opening 663. Therefore, the shell 66 can bear a high torsional force and is not easily to be damaged.

Figure 7:
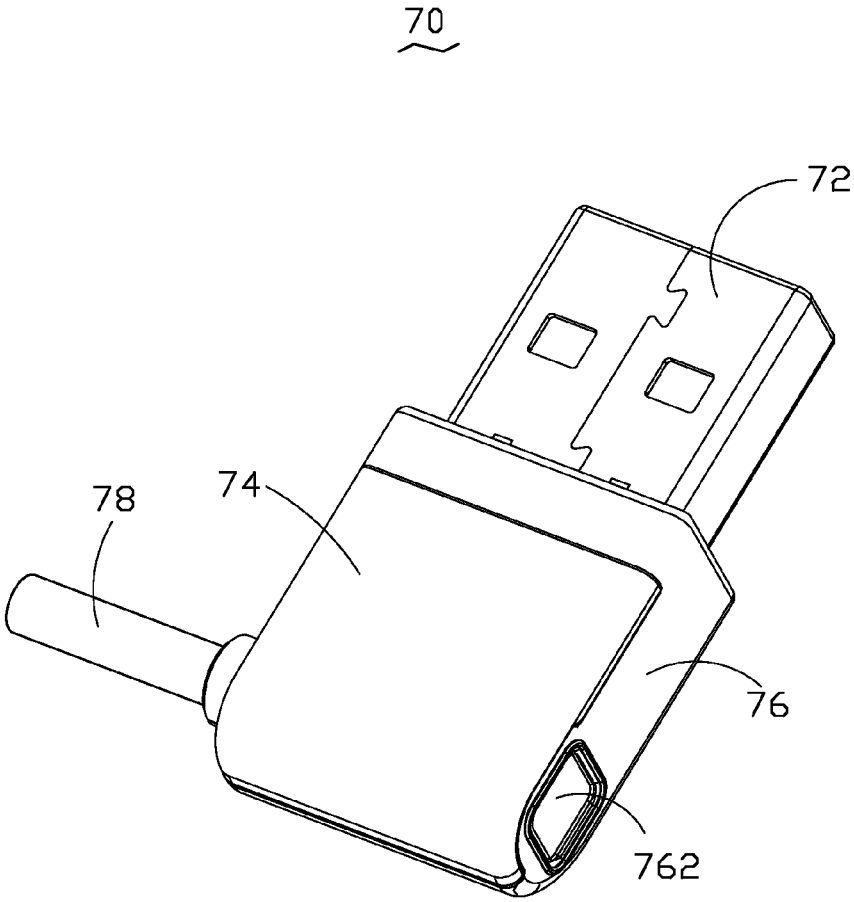
FIG. 7 is a perspective view of the USB connector in accordance with a second exemplary embodiment of the disclosure.

In FIG. 7, a USB connector 70 of the USB device 100 in accordance with a second exemplary embodiment of the disclosure is shown. The USB connector 70 comprises a USB plug 72, a cover 74, a shell 76 having a containing portion 762 and a wire group 78. Structures of the USB plug 72, the shell 76 and the wire group 78 are respectively same as that of the USB plug 62, the shell 66 and the wire group 68 of the first exemplary embodiment. Difference between the USB connector 70 of the second exemplary embodiment and the USB connector 60 of the first exemplary embodiment is a position relationship between the cover 74 and the containing portions 762. In the first exemplary embodiment, the cover 64 fails to shield the containing portion 662, as shown in FIG. 6. However, in the second exemplary embodiment, the containing portion 762 is shielded by the cover 74, as shown in FIG. 7.

Figure 8:
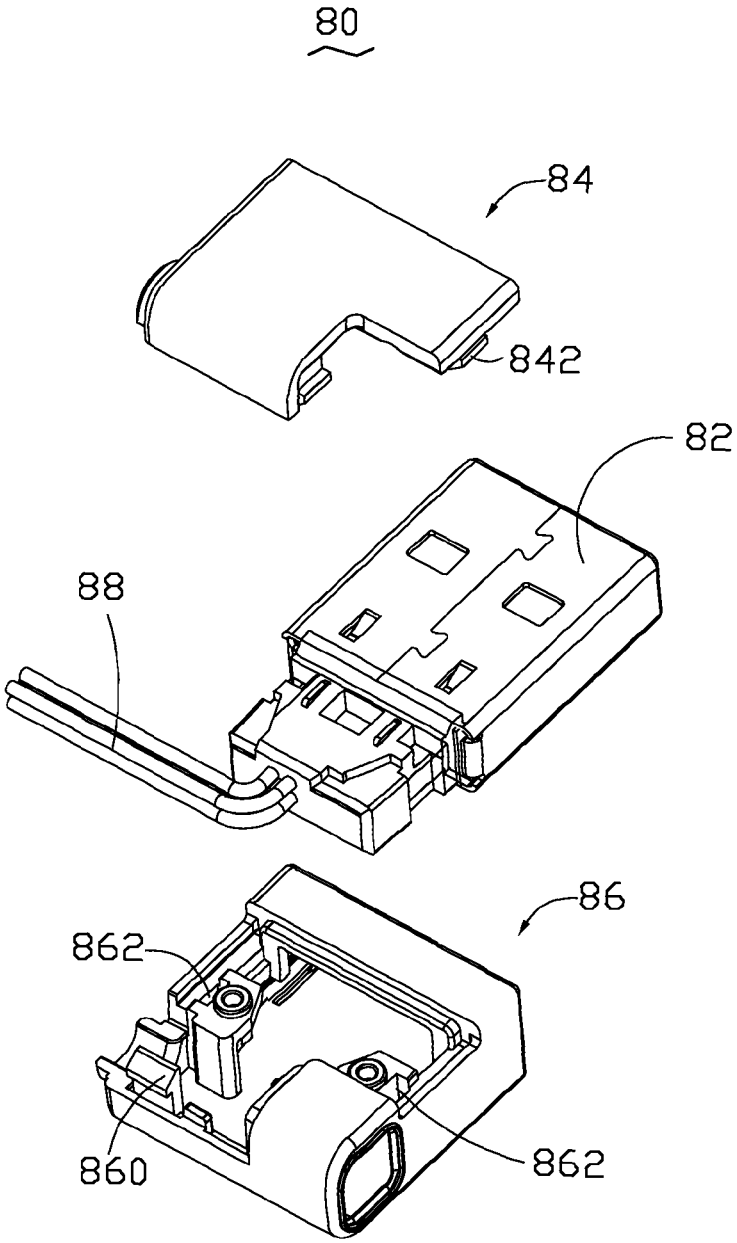
FIG. 8 is a disassembled perspective view of the USB connector in accordance with a third exemplary embodiment of the disclosure.
Figure 9:
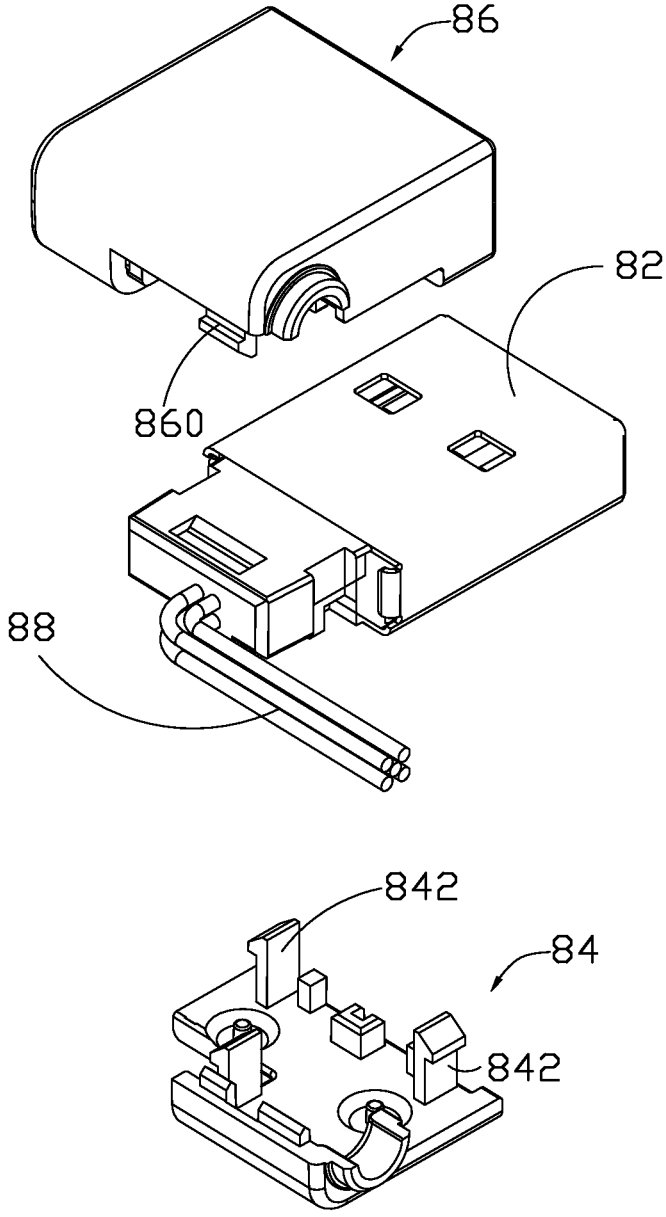
FIG. 9 is similar to FIG. 8, but shown in another direction.

In FIGS. 8-9, a USB connector 80 of the USB device 100 in accordance with a third exemplary embodiment of the disclosure is shown. The structure of the USB connector 80 comprising a USB plug 82, a cover 84, a shell 86 and a wire group 88 is similar to that of the USB connector 60 of the first exemplary embodiment. Difference between the USB connector 80 of the third exemplary embodiment and the USB connector 60 of the first exemplary embodiment is a securing structure between the cover 84 and the shell 86. In the first exemplary embodiment, the cover 64 is secured to the shell 66 by hot-melting method. However, in the second exemplary embodiment, the cover 84 is secured to the shell 86 by engagements between hooks and latching notches. The cover 84 comprises a plurality of first hooks 842 configured on edges of the cover 84, accordingly, the shell 86 defines a plurality of latching notches 862. The plurality of first hooks 842 engage with the plurality of latching notches 862 to secure the cover 84 to the shell 86. Furthermore, the shell 86 comprises a second hook 860 used to engage with an inner latching portion (not shown) of the cover 84.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A USB device, comprising a main body, a PCB fixed in the main body and a USB connector connected to the main body, the USB connector comprising:

a shell, defining a receiving room, a first opening and a second opening, and comprising an integrally formed enclosure enclosing the receiving room and a first flange outwardly protruding from the enclosure, the first opening formed at a front of the enclosure, and the second opening formed at a top of the enclosure;

a USB plug, electrically connecting to a wire group and partially inserted into the shell from the first opening; and a cover, shielding the second opening and fixed to the shell, the cover comprising a second flange engaging with the first flange to cooperatively receive the wire group and connect to the main body, wherein the wire group is inserted into the receiving room via the first opening and extends into the main body via the first flange and the second flange to electrically connect to the PCB.

2. The USB device as claimed in claim 1, wherein the enclosure comprises a pair of side walls, a front wall in which the first opening is formed, a back wall, a top wall and a bottom wall, the second opening is formed among the top wall, the pair of side walls and the back wall, the first flange outwardly protrudes from one of the pair of side walls and close to the back wall.

3. The USB device as claimed in claim 2, wherein an end surface of the first flange is half-annular shaped, and the second flange has a same structure with the first flange.

4. The USB device as claimed in claim 2, wherein the shell comprises a latching block inwardly protruding from the bottom wall, and the USB plug defines a latching groove used to engage with the latching block to position the USB plug to the shell.

5. The USB device as claimed in claim 2, wherein the shell comprises a pair of positioning portions close to the second opening and respectively inwardly protruding from the pair of side walls, part of the USB plug is received between the positioning portions and the bottom wall, the cover comprises a pair of positioning posts used to engage with the pair of positioning portions to position the cover to the shell.

6. The USB device as claimed in claim 2, wherein the cover comprises one or more first positioning blocks, the USB plug comprises one or more second positioning blocks, in assembly, the first positioning blocks respectively engage with the second positioning blocks.

7. The USB device as claimed in claim 2, further comprising a hinge assembly used to pivotably connect the USB connector to the main body.

8. The USB device as claimed in claim 7, wherein the shell comprises a containing portion configured at a corner of the shell, used to fix the hinge assembly and close to the back wall.

9. The USB device as claimed in claim 8, wherein the containing portion is shielded by the cover.

10. The USB device as claimed in claim 2, wherein the cover is secured to the shell by hot-melting method.

11. The USB device as claimed in claim 2, wherein the cover comprises a plurality of first hooks, the shell defines a plurality of latching notches used to engage with the plurality of first hooks to secure the cover to the shell.

12. A USB connector, comprising:

a shell, integrally formed by plastic material, comprising a pair of side walls, a front wall, a back wall, a top wall and a bottom wall, and defining a first opening formed in the front wall and a second opening formed among the top wall, the pair of side walls and the back wall, the shell further comprising a first flange outwardly protruding from one of the pair of side walls and close to the back wall;

a USB plug, electrically connecting a wire group and partially inserted into the shell from the first opening; and a cover, shielding the second opening and fixed to the shell, the cover comprising a second flange engaging with the first flange to cooperatively receive the wire group.

13. The USB connector as claimed in claim 12, wherein the first flange and the second flange cooperatively receive a middle section of the wire group.

14. The USB connector as claimed in claim 13, wherein an end surface of the first flange is half-annular shaped, and the second flange has a same structure with the first flange.

15. The USB connector as claimed in claim 12, wherein the shell comprises a latching block inwardly protruding from the bottom wall, the USB plug defines a latching groove used to engage with the latching block to position the USB plug to the shell.

16. The USB connector as claimed in claim 12, wherein the shell comprises a pair of positioning portions close to the second opening and respectively inwardly protruding from the pair of side walls, part of the USB plug is received between the positioning portions and the bottom wall, the cover comprises a pair of positioning posts used to engage with the pair of positioning portions to position the cover to the shell.

17. The USB connector as claimed in claim 12, wherein the cover comprises one or more first positioning blocks, the USB plug comprises one or more second positioning blocks, in assembly, the first positioning blocks respectively engage with the second positioning blocks.

18. The USB connector as claimed in claim 12, wherein the cover is secured to the shell by hot-melting method.

19. The USB connector as claimed in claim 12, wherein the cover comprises a plurality of first hooks, the shell defines a plurality of latching notches used to engage with the plurality of first hooks to secure the cover to the shell.

20. A USB device, comprising a main body, a PCB fixed in the main body and a USB connector pivotably connected to the main body, the USB connector comprising:

a shell, defining a receiving room, a first opening and a second opening, and comprising an integrally formed enclosure enclosing the receiving room and a first flange outwardly protruding from the enclosure, the first opening formed at front of the enclosure, and the second opening formed at top of the enclosure;

a USB plug, electrically connecting a wire group and partially inserted into the shell from the first opening; and a cover, shielding the second opening and fixed to the shell, the cover comprising a second flange engaging with the first flange to cooperatively connect to the main body and provide a passage for the wire group being inserted into the main body to electrically connect to the PCB.

* * * * *